US005917393A

United States Patent [19]

Kupiszewski et al.

[11] Patent Number: 5,917,393

[45] Date of Patent: Jun. 29, 1999

[54] SUPERCONDUCTING COIL APPARATUS AND METHOD OF MAKING

[75] Inventors: Thomas Kupiszewski, Middelton, Wis.; Timothy K. Deis, Pittsburgh, Pa.

[73] Assignee: Northrop Grumman Corporation, Los Angeles, Calif.

[21] Appl. No.: 08/852,973

[22] Filed: May 8, 1997

[51] Int. Cl.[6] ..... H01F 5/08

[52] U.S. Cl. ..... 335/216; 174/125.1; 505/704; 505/705; 505/879

[58] Field of Search ..... 335/216; 336/DIG. 1; 174/125.1; 505/211, 212, 213, 230, 231, 704, 705, 879, 880, 884; 29/599

[56] References Cited

U.S. PATENT DOCUMENTS

| | | | |
|---|---|---|---|
| 3,428,925 | 2/1969 | Bogner et al. | 335/216 |
| 4,040,173 | 8/1977 | McDougall | 29/599 |
| 4,905,316 | 2/1990 | Okamoto | 324/319 |

*Primary Examiner*—Michael L. Gellner
*Assistant Examiner*—Raymond Barrera
*Attorney, Agent, or Firm*—Walter G. Sutcliff

[57] ABSTRACT

A superconducting coil mounted on, and in heat transfer relationship with, a heat conducting support cylinder. The superconducting coil is electrically insulated from the support cylinder by means of a refractory ceramic coating, such as aluminum oxide, on the surface of the cylinder or on an intermediate layer which itself is on the surface of the cylinder. To resist Lorentz forces, the superconducting coil may be positioned within a helical groove machined into the inside or outside surface of the cylinder.

10 Claims, 7 Drawing Sheets

SUPERCONDUCTING COIL APPARATUS AND METHOD OF MAKING

BACKGROUND OF THE INVENTION

1. Field of the Invention

The invention in general relates to superconducting magnets, and more particularly to an improved cooling arrangement therefor.

2. Description of Related Art

Superconducting magnets operate at extremely low temperatures and find utility in a variety of applications such as magnetic resonance imaging, ore separation and magnetic influence minesweeping, to name a few.

Superconducting magnets operated at cryogenic temperatures make use of the fact that the electrical resistivity of certain metals drops with decreasing temperature, thus lowering the power consumed by the magnet itself. The operation requires cooling at cryogenic temperatures near absolute zero and such cooling typically is accomplished with liquid helium at a temperature of around 4° Kelvin in a forced flow or pool boiled convection mode. The use of liquid helium and the requirement for constant replenishment contributes to the high cost of operation of various types of superconducting equipment. Further, liquid helium storage and handling are a logistic impediment to the use of superconducting coils for magnetic influence mine sweeping, particularly when the carrying platform must operate reliably under harsh conditions in the marine environment.

In an effort to eliminate the requirement for liquid helium to maintain superconductivity, another type of cooling arrangement, conduction cooling, may be utilized. In conduction cooling of a magnet, the superconducting coil is cooled by conduction heat transfer to a nominally isothermal heat sink maintained at a sufficiently cold temperature by one or more cryocoolers employing closed cycle refrigeration. For conduction cooled magnets proper operation requires that the maximum heat dissipation rate via conduction exceed the net heat generation rate.

Typical sources of heat input which may significantly reduce efficiency or destroy superconductive operation, include AC losses, losses in joints, cold mass support heat losses, and heat conduction along unventilated current leads. Additional sources of heat may, depending upon the application, include friction and mechanical hysteresis due to vibration and/or transient stress wave propagation. Accordingly, the efficiency of conduction heat transfer within the superconducting magnet must be maximized in order to minimize the temperature difference between the heat sink and peak conductor temperature of the coil.

The present invention provides for a design which will meet the required objective of maximizing conduction heat transfer between a superconducting coil and a cryocooler.

SUMMARY OF THE INVENTION

Superconducting coil apparatus in accordance with the present invention includes a heat conducting support cylinder having a longitudinal axis, with an electrically insulating, heat conducting refractory ceramic coating contiguous a surface of the cylinder. A superconducting coil having a longitudinal axis coaxial with the longitudinal axis of the support cylinder is positioned relative to the support cylinder, either on the inside or outside, with an intermediate bonding interface which bonds the superconducting coil to the ceramic coating. In a preferred embodiment the intermediate bonding interface includes two layers, one a buffer coating for better bonding with the ceramic coating and a second, for better bonding with the superconducting coil.

DESCRIPTION OF THE PREFERRED EMBODIMENT

Figure 1:
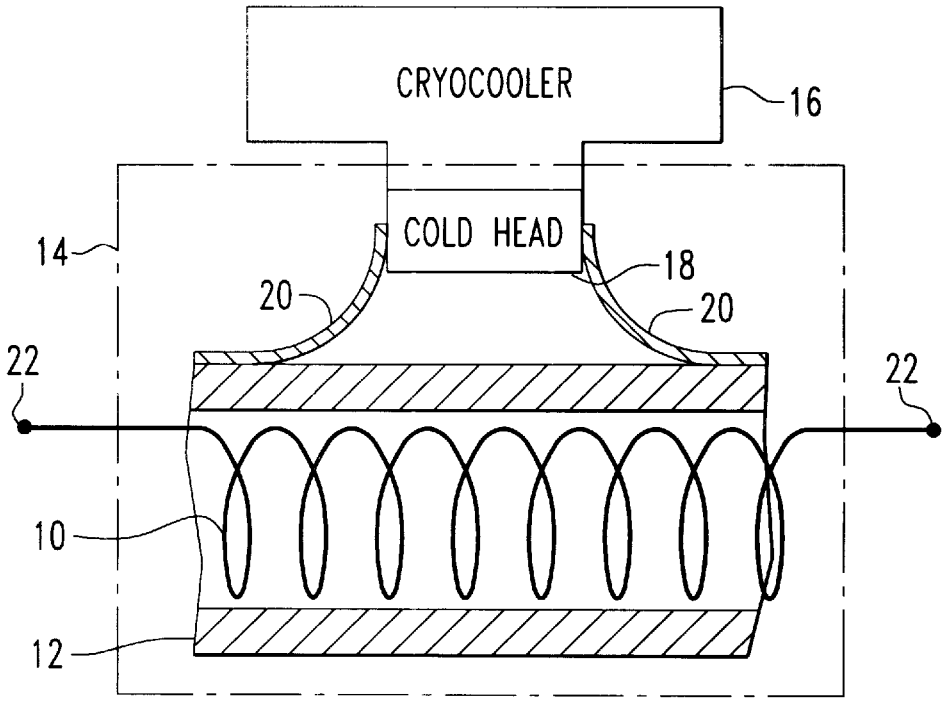
FIG. 1 is a schematic presentation of a conduction cooling arrangement.

Referring now to FIG. 1 there is illustrated the basic elements of a cryocooler for cooling a superconducting coil. The superconducting coil 10 is mounted on a support cylinder 12 which also functions as a heat sink, with the coil 10 and support cylinder 12 being contained within a vacuum enclosure 14. A cryocooler refrigerant system 16 includes a cold head 18 positioned within the vacuum enclosure 14 and is in heat transfer relationship with the support cylinder 12 by means of thermally conductive strapping 20 for removing generated heat. Electrical potential is applied to the coil 10 during operation by means of terminals 22, located outside of the vacuum enclosure 14.

Figure 2:
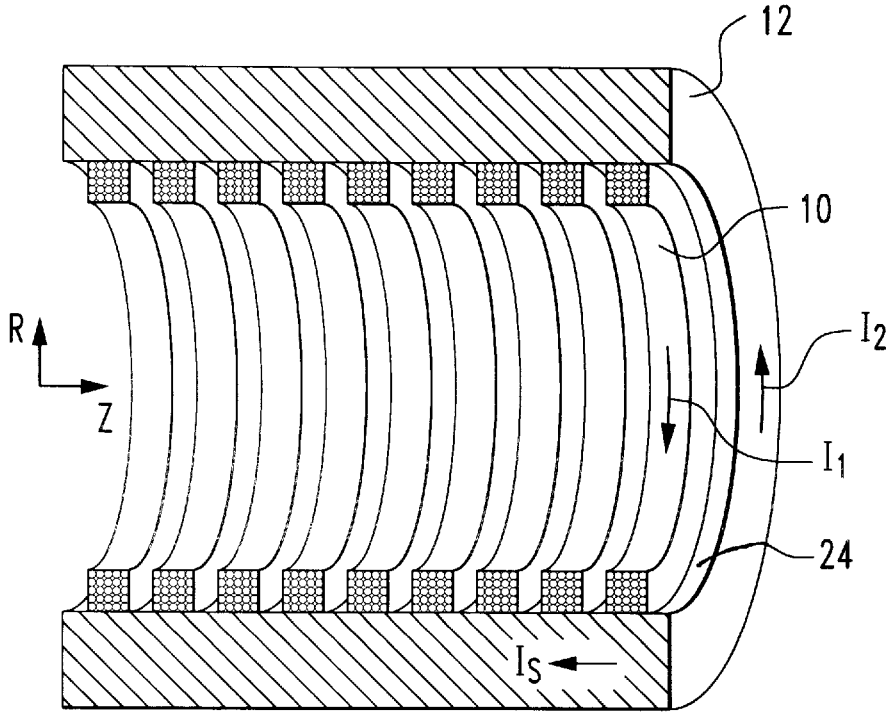
FIG. 2 PRIOR ART
FIG. 2 is a sectional view of a superconducting coil of the prior art.

FIG. 2 illustrates the coil and support arrangement in more detail. The coil 10 has a plurality of turns which extend along and surround a longitudinal axis Z. in order to reduce the difference between the coil temperature and the support cylinder temperature, the turns of coil 10 are directly soldered to the inside surface 24 of the support cylinder 12, which may be of aluminum. With such arrangement, under certain field ramping conditions there are ohmic losses produced in the aluminum cylinder 12 which cannot be accommodated by the cooling system. This may be illustrated by additional reference to FIG. 3.

Figure 3:
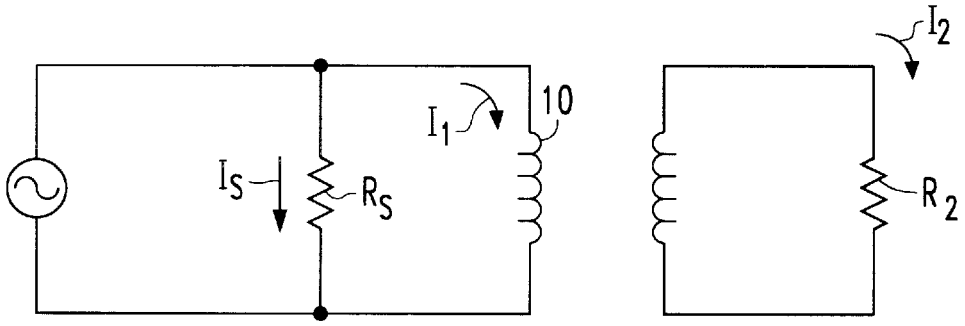
FIG. 3 is an electrical circuit equivalent of the coil arrangement of FIG. 2.
Figure 4:
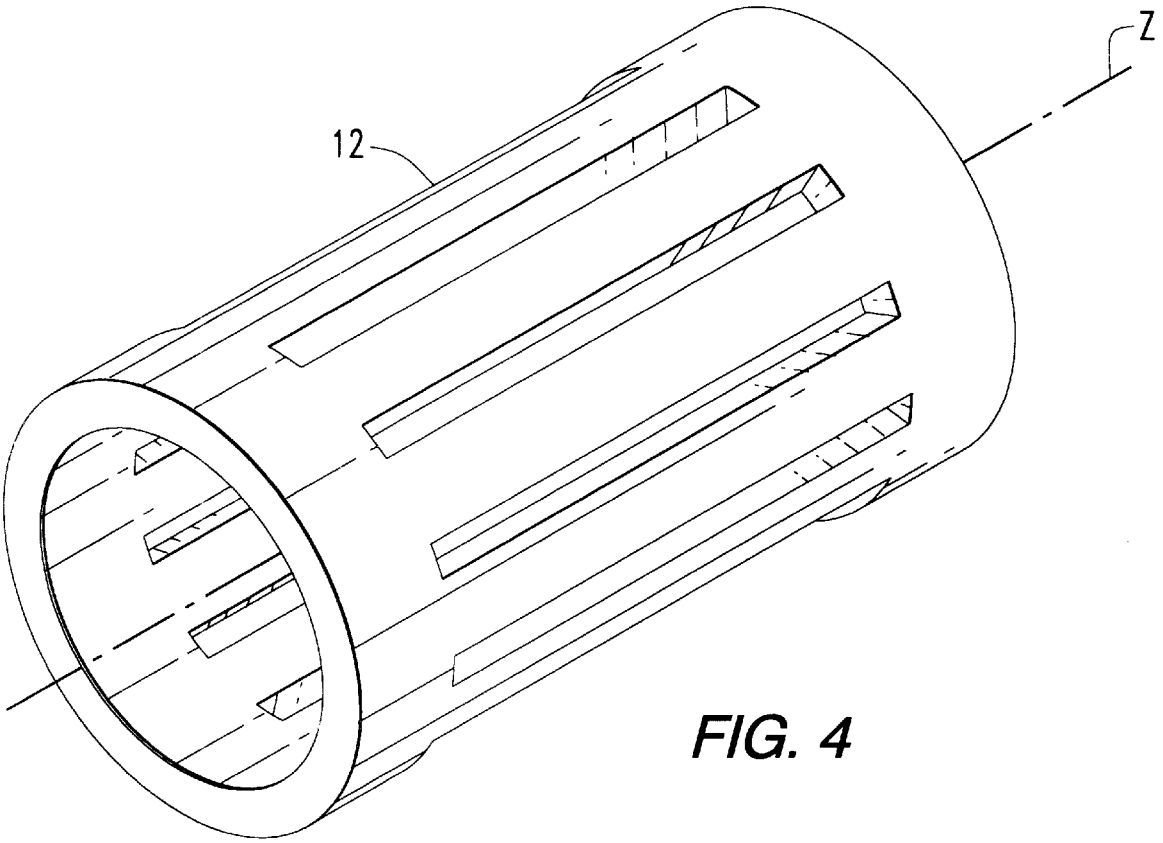
FIG. 4 is a view of a support member having longitudinal slots.

FIG. 3 is a simplified equivalent electrical circuit representation wherein $I_1$ represents the current flowing in the coil 10 due to a voltage applied to the coil terminals 22 (FIG. 1). The current produces a magnetic flux which almost entirely links the aluminum cylinder. A second current, $I_2$, is induced in the cylinder to oppose the change in the field. Basically, the cylinder would act as a single turn secondary of an air core current step up transformer with lumped secondary resistance $R_2$. If it is assumed that the cylinder 12 is slotted, as in FIG. 4, $R_2$ approaches infinity and $I_2$ approaches zero. The circuit then reduces to a parallel RL circuit.

Since the coil 10 is soldered to the cylinder 12 it is electrically connected and the terminal voltage is therefore applied across the cylinder and a shunt current $I_s$ flows along the cylinder in a direction parallel to the cylinder axis Z. For aluminum alloys cooled to cryogenic temperatures, the resistance, $R_s$, associated with this shunt current flow is, for example, on the order of 0.1 to 1 micro-ohms. Typical self inductance of the coil for small to medium size applications is on the order of 1 millihenry. Even if low modulation frequencies are applied to the coil terminals, the reactive component of the coil impedance dominates the resistive component. The result is that most of the power supply current flows within, and heats the aluminum cylinder thus degrading operation or requiring a greater capacity cryo-cooler system.

Figure 5:
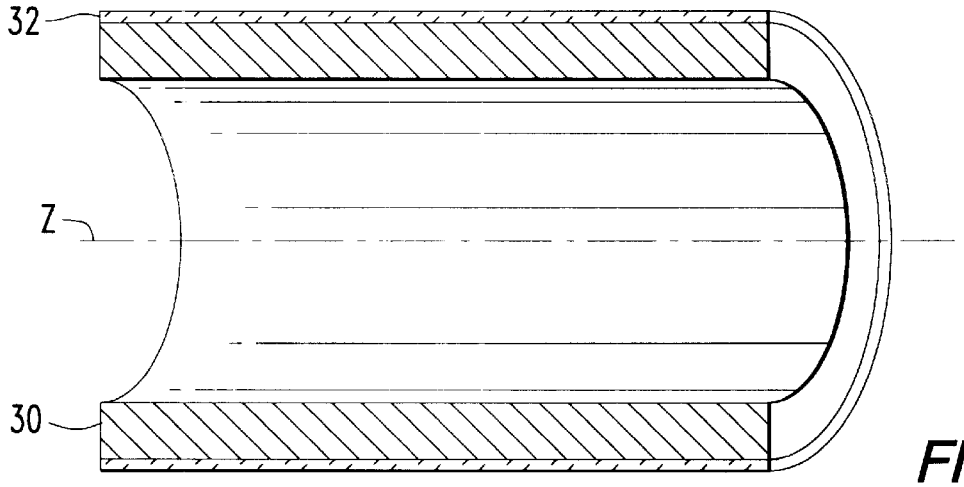
FIGS. 5–10 illustrate the fabrication of a superconducting coil arrangement in accordance with one embodiment of the present invention.

The present invention provides a solution to this heating problem and to this end reference is made to FIGS. 5 to 10 illustrating one embodiment of the invention. In FIG. 5, a support cylinder 30 serving also as a heat sink extends along a central longitudinal axis Z. The cylinder 30 is suitably prepared by a grit blasting operation to clean and roughen a selected surface. A refractory ceramic coating 32 is applied contiguous the prepared surface of the cylinder 30 and in the embodiment shown, the coating 32 is applied to the outside surface, and directly on it. The refractory ceramic coating 32 functions as a high thermal conductivity insulation which will electrically isolate the cylinder 30 from the superconducting coil to be affixed, thus effectively eliminating the undesired current $I_s$, but presents negligible impedance to conduction heat transfer so that superconducting temperatures may be maintained. Examples of suitable materials for the cylinder 30 include aluminum, aluminum alloys and iron-nickel alloys, to name a few.

The refractory ceramic coating 32 is preferably applied to the surface of the cylinder 30 by means of flame spraying. Examples of refractory ceramic coatings include refractory oxides such as aluminum oxide, chromium oxide and zirconium oxide, as well as non oxides such as tungsten carbide. These materials possess thermal conductivities which exceed epoxy-based coil encapsulating materials by a factor of 18 (tungsten carbide) to 70 (aluminum oxide).

Figure 6:
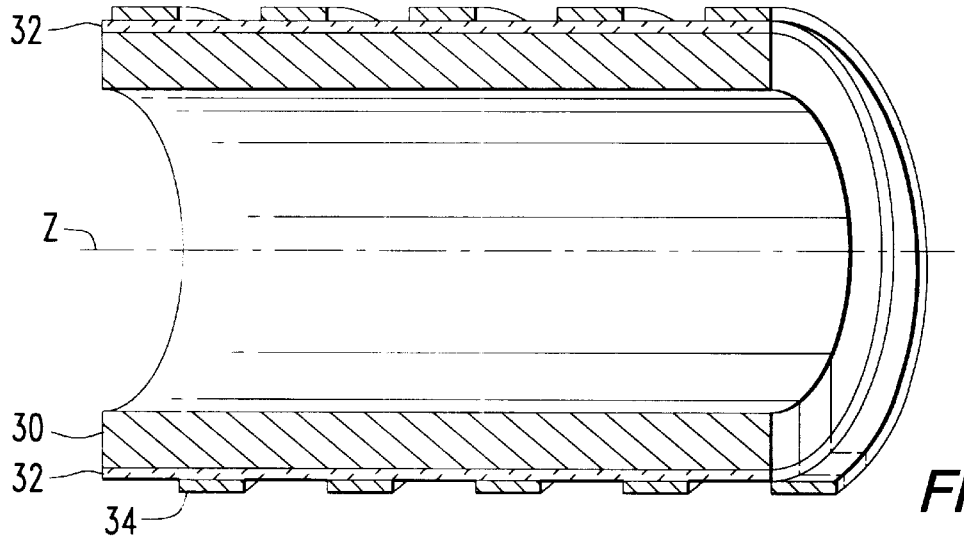

The next step in the fabrication is illustrated in FIG. 6 and consists in the application of a helical masking strip 34 to the surface of the refractory ceramic coating 32. Masking strip 34, which may be made of a high temperature material such as glass or quartz fiber tape, has a pitch which is equivalent to the pitch of the superconducting coil to be affixed.

Figure 7:
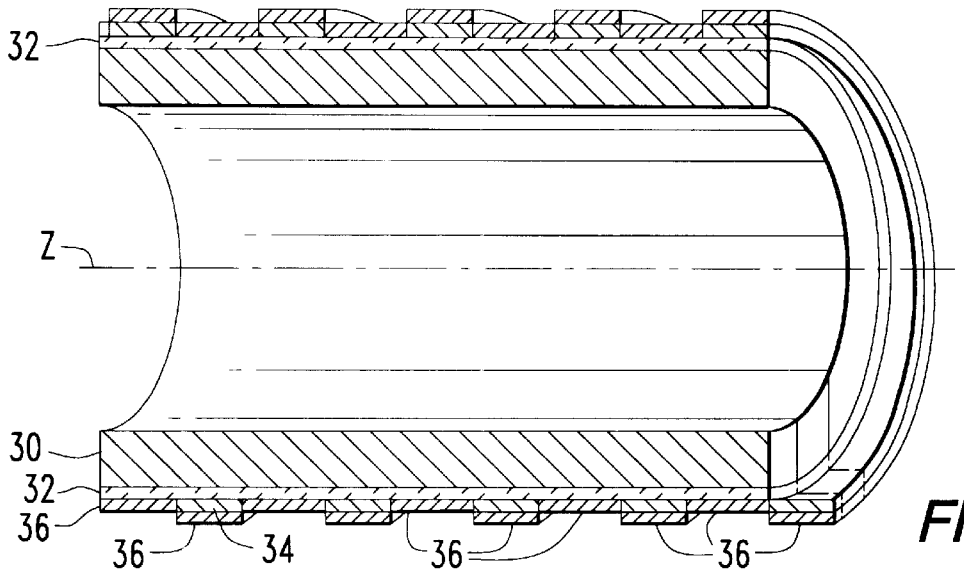
Figure 8:
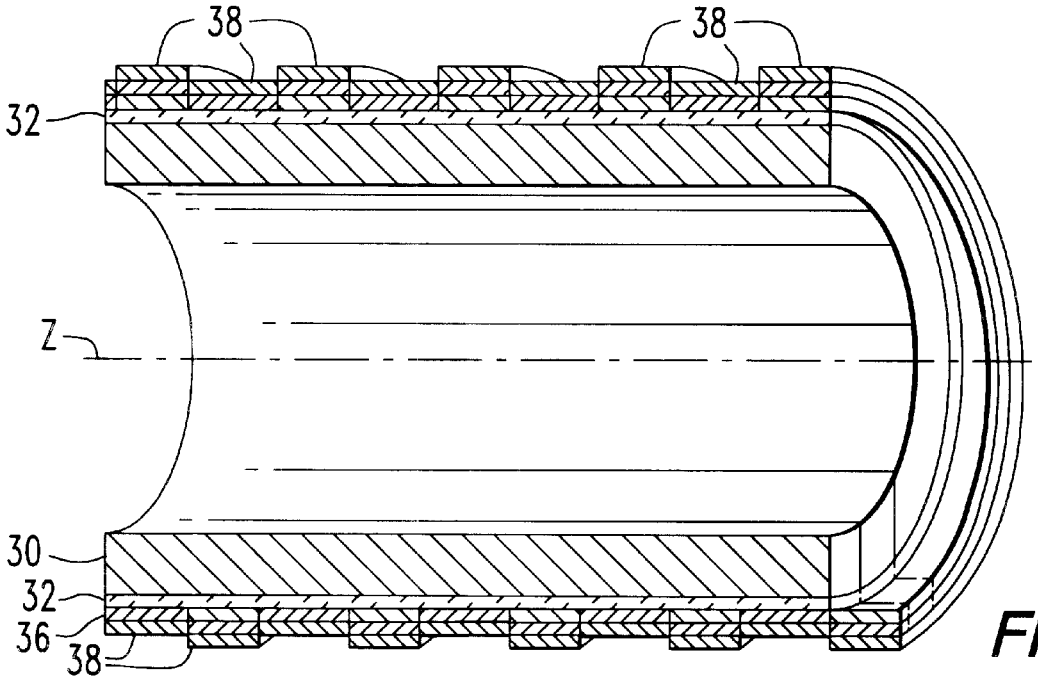
Figure 9:
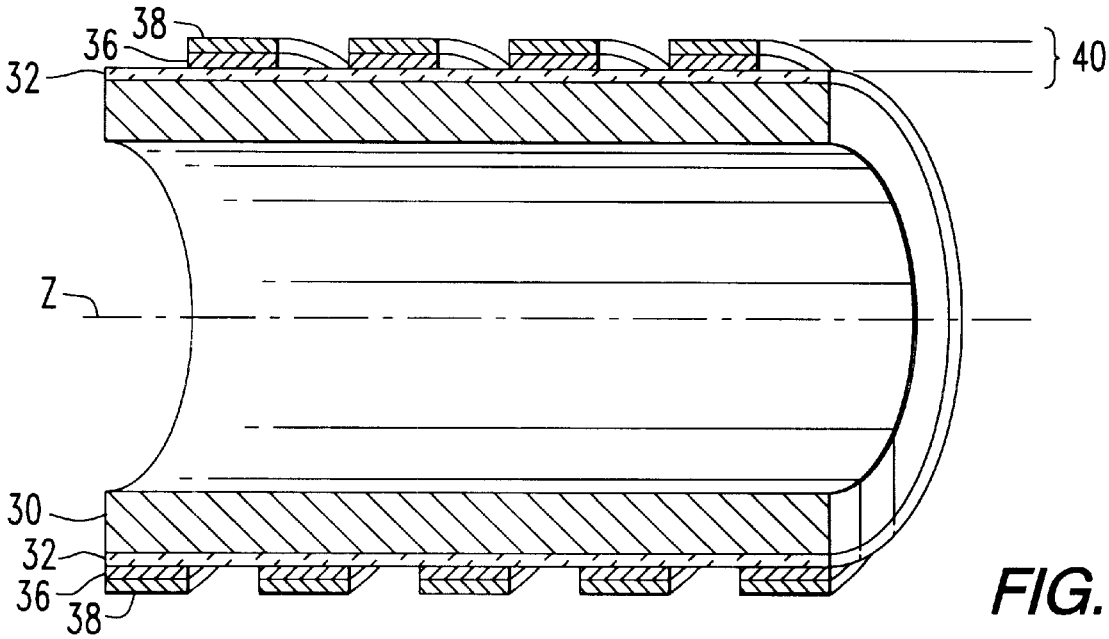

Between the superconducting coil and refractory ceramic coating 32 is an intermediate bonding interface. In one preferred embodiment this intermediate bonding interface is composed of two layers. Assuming, by way of example, a cylinder 30 of aluminum, and a coating 32 of aluminum oxide, and as illustrated in FIG. 7, a first interface layer in the form of buffer layer 36, comprised of nickel-aluminide, is flame sprayed over the exposed portions of coating 32, and masking tape 34. As illustrated in FIG. 8, a second interface layer in the form of tin layer 38 is then flame sprayed over the nickel-aluminide 36. The masking strip 34 may then be removed, as in FIG. 9, leaving a helical coating of an intermediate bonding interface 40 comprised of nickel-aluminide layer 36 and tin layer 38. The nickel-aluminide adheres well to the aluminum oxide coating 32 and promotes better bonding with the tin layer 38.

Figure 10:
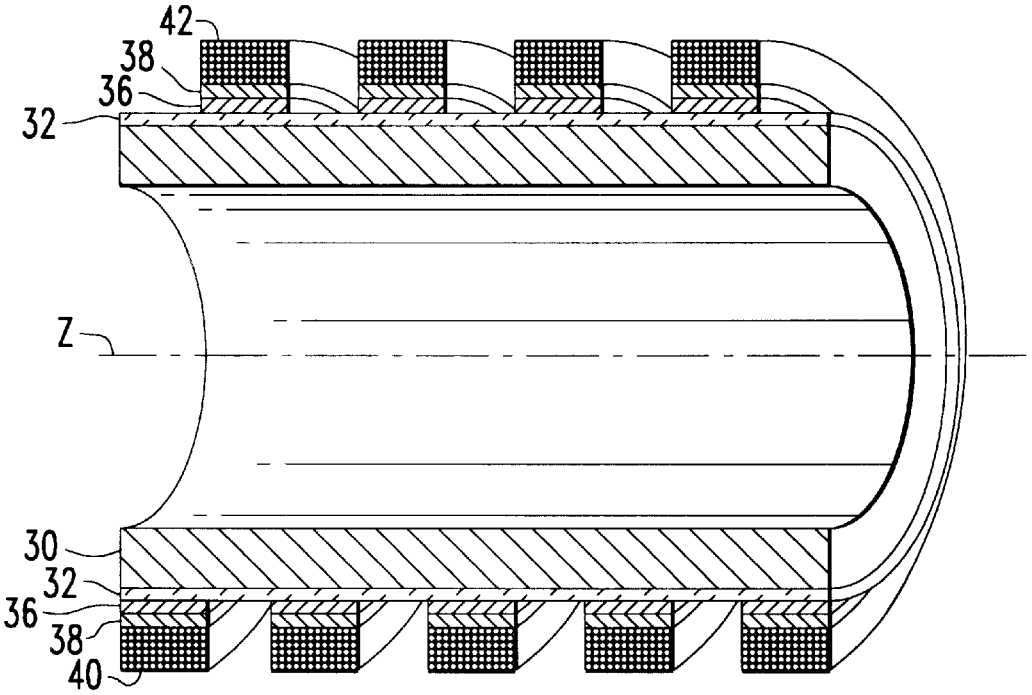

The helical tin layer 38 provides an interface for bonding of the superconducting coil which has a longitudinal axis Z coaxial with the cylinder 30 axis. In FIG. 10 the superconducting coil 42, which may be either a monolith or a multi-strand fully transposed cable, has a pre-tinned surface for bonding to the prepared helical tin surface, by means of a solder reflow operation. For superconductors with other than a pre-tinned matrix, other suitable bond enhancing layers, metal or otherwise, may be substituted for tin layer 38.

Figure 11:
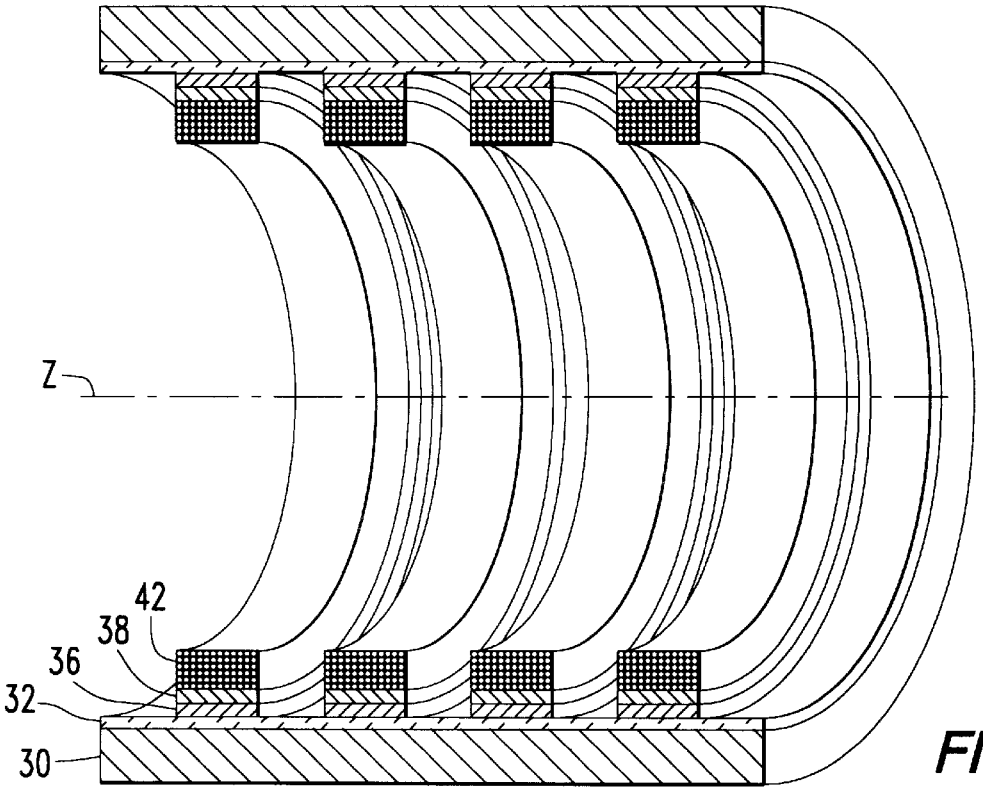
FIG. 11 illustrates an alternate placement of the superconducting coil on its support.

Although FIGS. 5 to 10 depict the fabrication of a superconducting coil arrangement having the superconducting coil on the outside surface of a heat conducting support cylinder, the teachings herein are equally applicable to an arrangement wherein the superconducting coil is on the inside surface of the cylinder. This is illustrated in FIG. 11 where the components have been given the same respective numerical designations as in FIG. 10.

Figure 12:
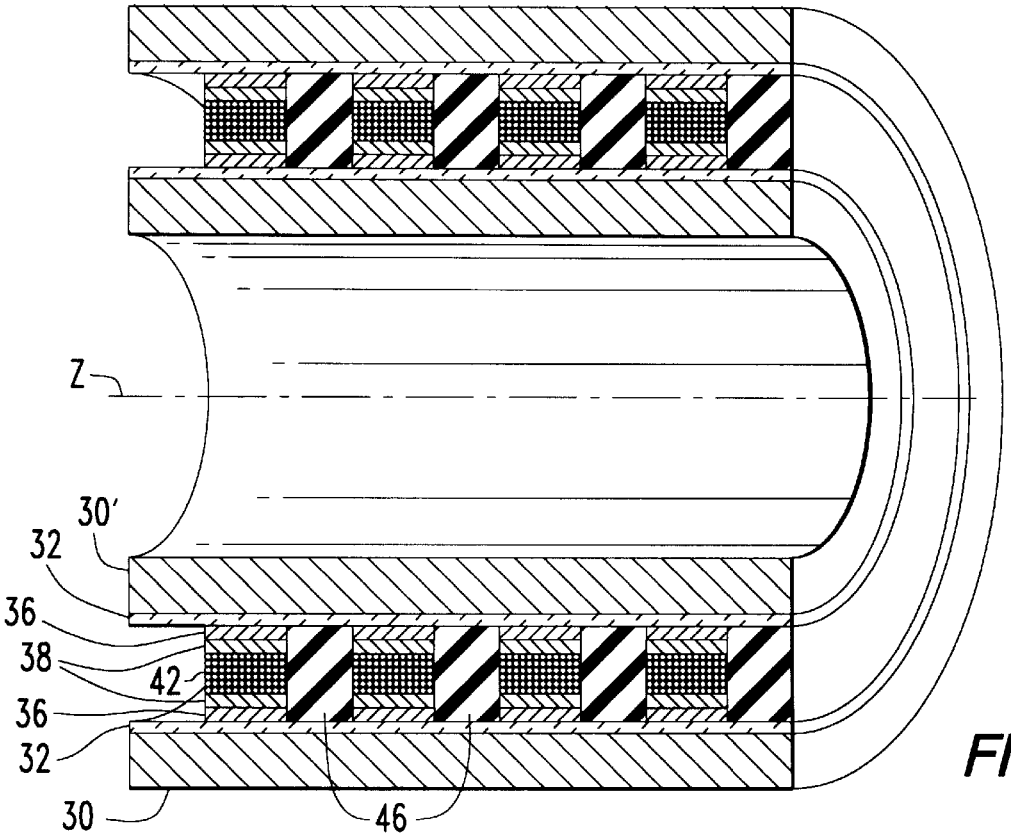
FIG. 12 illustrates a sandwich arrangement with the superconducting coil between two support members.

FIG. 12 illustrates an embodiment which incorporates the latter two embodiments. That is, the superconducting 20 coil 42 is connected adjacent the inside surface of an outer cylinder 30 and adjacent the outside surface of an inner cylinder 30' with all of the coatings and layers previously described . Both cylinders 30 and 30' and the superconducting coil 42 are coaxial along axis Z.

During operation when electric potential is applied to the terminals of the superconducting coil 42 there is electron flow. The force experienced by the electrons moving in the region of magnetic flux density is called the Lorentz force. The force acts in a direction that is perpendicular both to the direction of electron motion and flux density. Near the coil end turns, the predominant force component is parallel to the Z axis in a finite length solenoid winding and accordingly it may be desirable to provide a means for preventing debonding of the superconductor in the presence of such forces. In one method, and as illustrated in FIG. 12, the void space between turns of the coil 42 may be filled with a potting material such as an alumina filled epoxy 46 applied by vacuum pressure impregnation. In another method, the Lorentz forces are restrained by the cylinder material itself. This is illustrated in FIG. 13 to which reference is now made.

Figure 13:
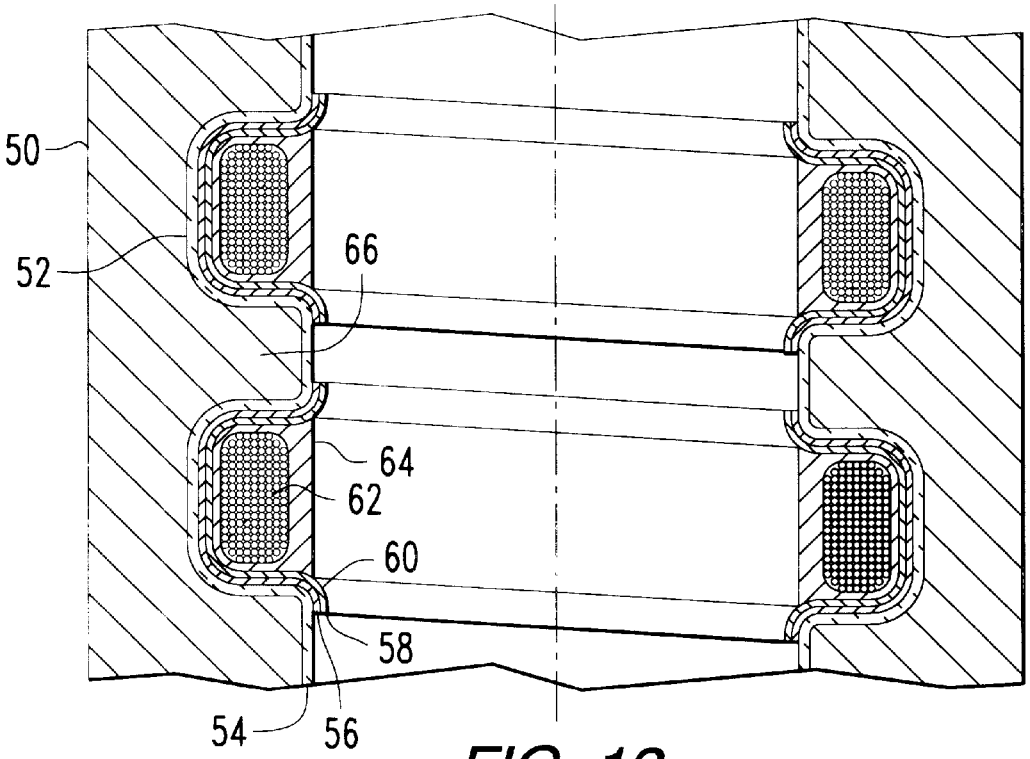
FIGS. 13 and 14 illustrate other embodiments wherein the superconducting coil is embedded within the wall of a support member.

In FIG. 13 a cylindrical heat conducting support cylinder 50 has a helical groove 52 machined into its inside surface. A refractory ceramic coating 54 is applied, such as by flame spraying, to the entire inner surface, including the machined groove 52. An intermediate bonding interface 56 comprised of a buffer layer 58 and tin layer 60 is next applied. A superconducting coil 62 is threaded into the machined groove 52 and is thereafter held in position by means of solder 64 deposited in a solder reflow operation. It is to be noted that the machined groove 52, as well as the coil 62 conductor have rounded corners which reduce peak electric field strengths compared to right angle or chamferred corners. The need for potting material is eliminated by virtue of the helical land portion 66 which exists between turns of the superconducting coil 62 and which restrains any axial movement of the superconducting coil 62.

Figure 14:
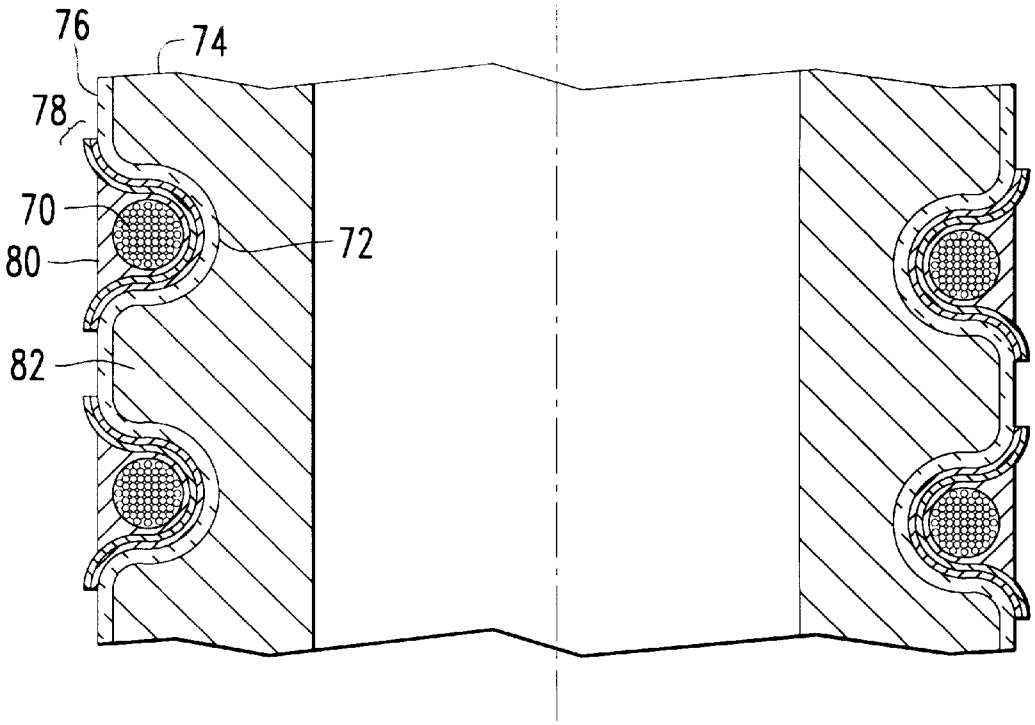

The embodiment of FIG. 14 is similar to that of FIG. 13 except that a superconducting coil 70 is positioned within a machined helical groove 72 on the outside surface of a heat conducting support cylinder 74. In this embodiment the superconductor, as well as the helical groove 72, is rounded. A refractory ceramic coating 76 is applied to the outside surface and a two layer intermediate interface 78 is applied as previously described. Thereafter, the superconducting coil 70 is threaded into the machined helical groove 72 and maintained in position by means of solder 80. As was the case with respect to the embodiment of FIG. 13, the axial directed Lorentz forces are restrained by helical land portion 82.

In the embodiments described, the ceramic coating is applied directly to the surface of the supporting cylinder. In addition, an interface layer such as a nickel-aluminide layer has been described for achieving increased adhesion strength between the ceramic coating and the metalized portion of the interface with the superconductors. In another embodiment, and as illustrated in FIG. 15, an interface layer may be incorporated to increase adhesion strength between the support cylinder and the ceramic coating.

Figure 15:
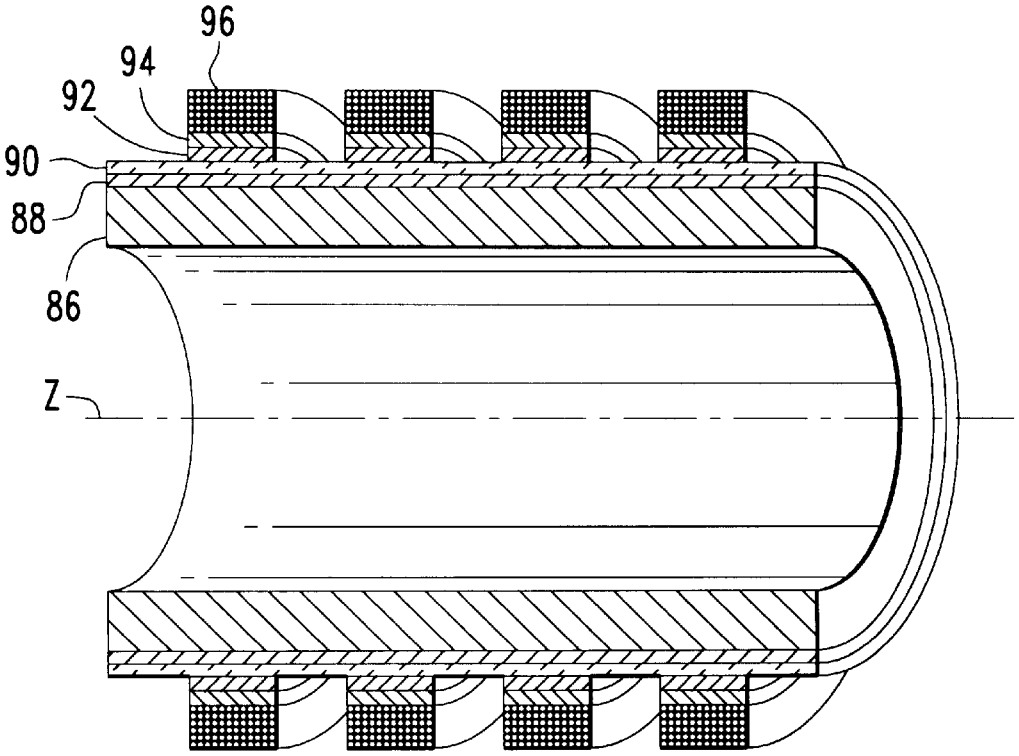
FIG. 15 is an axial cross sectional view illustrating another embodiment of the invention

Thus in FIG. 15 a suitably cleaned support cylinder 86 has an interface layer 88, of nickel-aluminide, on its surface applied by flame spraying. The ceramic coating 90 is then applied by plasma spraying and the procedure outlined in FIGS. 6 to 10 is followed, resulting in a structure having a helical nickel-aluminide layer 92 over the ceramic coating 90, a tin layer 94 over the nickelaluminide layer 92 and the superconducting coil 96 bonded to the structure such as by a solder reflow process.

Accordingly there has been provided a superconducting coil arrangement wherein the heat conducting support member may be thermally connected with the cold head of a cryocooler refrigerant system to maintain cryogenic temperatures necessary for superconductor operation. The arrangement, while providing for the necessary heat removal, eliminates any cylinder shunt currents which would contribute to heat buildup. In this regard, the support cylinders illustrated in FIGS. 5 to 15 may be slotted as in FIG. 4, to reduce or eliminate circumferential currents.

What is claimed is:

1. Superconducting coil apparatus, comprising:

(a) a heat conducting aluminum support cylinder extending along a longitudinal axis;

(b) an electrically insulating heat conducting aluminum oxide refractory ceramic coating contiguous a surface of said cylinder;

(c) a superconducting coil having a longitudinal axis coaxial with said longitudinal axis of said cylinder;

(d) a multilayer intermediate bonding interface disposed between said superconducting coil and said refractory ceramic coating, bonding said superconducting coil with said refractory ceramic coating; and wherein (e) said superconducting coil has a tin coating thereon;

(f) said intermediate bonding interface includes at lest two layers;

(g) one of said layers being tin;

(h) said tin layer being in contact with said tin coating;

(i) the other of said two layers being nickel aluminide;

(j) said nickel aluminide layer being in contact with said aluminum oxide.

2. Apparatus according to claim 1 wherein:

(a) said refractory ceramic coating is on the outside surface of said cylinder.

3. Apparatus according to claim 1 wherein:

(a) said refractory ceramic coating is on the inside surface of said cylinder.

4. Apparatus according to claim 1 which includes:

(a) a potting material positioned between and contacting adjacent turns of said superconducting coil.

5. Apparatus according to claim 1 which includes:

(a) first and second coaxial heat conducting support cylinders;

(b) said superconducting coil being positioned between the inside surface of said first cylinder and the outside surface of said second cylinder;

(c) first and second electrically insulating, heat conducting refractory ceramic coatings respectively on said inside surface of said first cylinder and on the outside surface of said second cylinder; and (d) first and second intermediate bonding interfaces respectively positioned between said superconducting coil and said first and second refractory ceramic coatings.

6. Apparatus according to claim 1 wherein:

(a) said cylinder has a helical groove in the outside surface thereof;

(b) said superconducting coil being positioned within said groove.

7. Apparatus according to claim 1 wherein:

(a) said cylinder has a helical groove in the inside surface thereof;

(b) said superconducting coil being positioned within said groove.

8. Apparatus according to claim 1 wherein:

(a) said cylinder includes a plurality of longitudinal slots therethrough.

9. Apparatus according to claim 1 which includes:

(a) an intermediate layer between said surface of said support cylinder and said refractory ceramic coating to promote bonding of said refractory ceramic coating.

10. Apparatus according to claim 9 wherein:

(a) said intermediate layer is nickel-aluminide.

* * * * *